United States Patent [19]

Allen et al.

[11] 4,189,014

[45] Feb. 19, 1980

[54] ENHANCED CROSS-FLOW WITH TWO JET DRILLING

[75] Inventors: James H. Allen, Lakewood; William Baker, III, Costa Mesa, both of Calif.

[73] Assignee: Smith International, Inc., Newport Beach, Calif.

[21] Appl. No.: 933,628

[22] Filed: Aug. 14, 1978

[51] Int. Cl.[2] ..... E21B 9/08

[52] U.S. Cl. ..... 175/339

[58] Field of Search ..... 175/339, 340, 393, 333, 175/65, 67; 299/81

[56] References Cited

U.S. PATENT DOCUMENTS

| | | | |
|---|---|---|---|
| 1,922,436 | 8/1933 | Herrington | 175/340 |
| 1,999,131 | 4/1935 | Reed | 175/339 |
| 2,207,766 | 7/1940 | Thompson | 175/340 X |
| 2,776,115 | 1/1957 | Williams, Jr. | 175/339 |
| 3,363,706 | 1/1968 | Feenstra | 175/340 |
| 3,509,952 | 5/1970 | Galle | 175/339 |
| 3,618,682 | 11/1971 | Bennett | 175/65 |
| 4,022,285 | 5/1977 | Frank | 175/340 |
| 4,126,194 | 11/1978 | Evans | 175/340 |

FOREIGN PATENT DOCUMENTS

| | | | |
|---|---|---|---|
| 2529380 | 1/1976 | Fed. Rep. of Germany | 175/340 |
| 258972 | 12/1969 | U.S.S.R. | 175/339 |

*Primary Examiner*—James A. Leppink
*Assistant Examiner*—Richard E. Favreau
*Attorney, Agent, or Firm*—Knobbe, Martens, Olson, Hubbard & Bear

[57] ABSTRACT

A drill bit having three cone-shaped cutters is formed with two drilling fluid nozzles on opposite sides of one of the cutters and with an enlarged return passage for the drilling fluid being formed between the other two cutters. Flow restrictors adjacent the two nozzles restrict the flow of return fluid in those areas. A flow diverter in the dome area of the bit extends into the space between the cutters to better direct fluid across the bottom of the hole where cuttings are being generated by the cutter teeth.

10 Claims, 6 Drawing Figures

Fig. 1
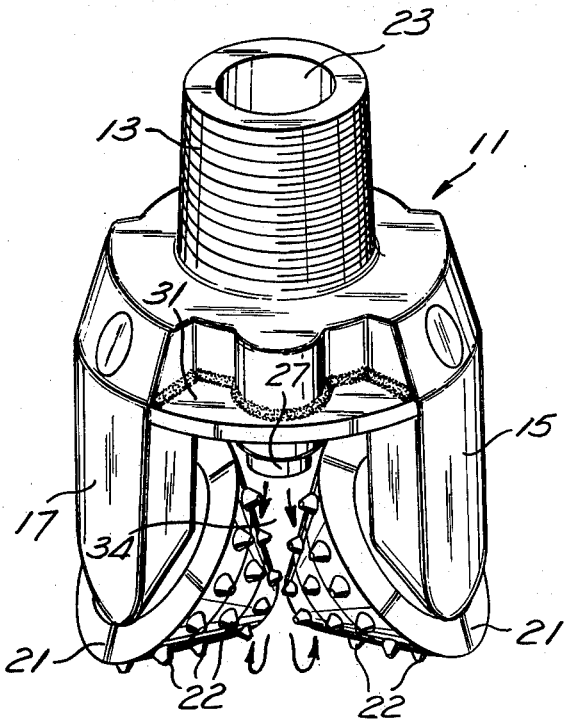
Fig. 2
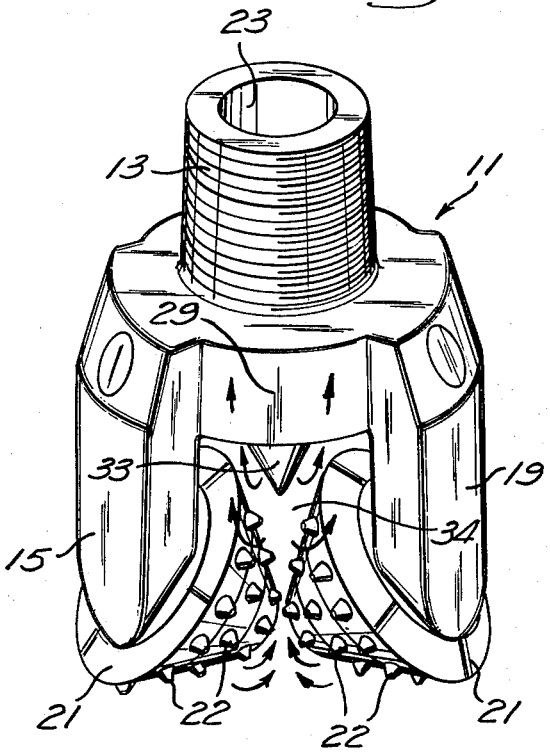
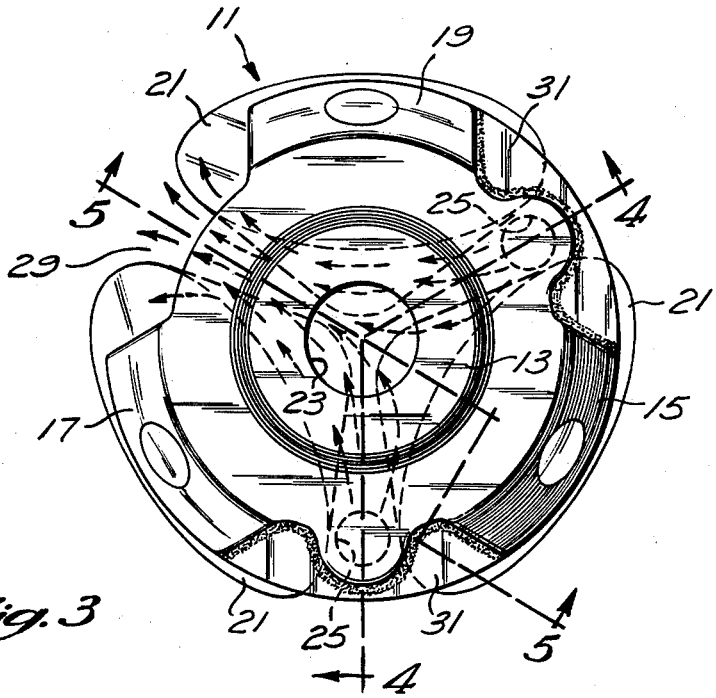
Fig. 3

ENHANCED CROSS-FLOW WITH TWO JET DRILLING

TECHNICAL FIELD

This invention relates to drilling bits used in earth boring operations and more particularly relates to hydraulic circulation systems for cleaning holes being drilled in rock and earth, as in the oil industry or in the mining industry. It further relates to an arrangement which improves the removal of cuttings from a drilled hole by diverting fluid along the surface of the cutters and directing fluid across the hole bottom.

BACKGROUND OF PRIOR ART

With the significant advances that have been made in drill bit technology, one of the limiting characteristics of the speed and efficiency of drilling operations is the removal of drill cuttings away from the bottom of the hole. Thus, it is important to provide the desired combination of drilling fluid flow velocity and flow volume.

One of the limiting parameters in three-cutter drill bits is the lack of space for fluid flow passage from the hole bottom to the top of the bit. The largest passageway is in the area of the nozzles between cutters but the submerged jet or nozzle stream entrains a great portion of the rising fluid and recirculates it to the hole bottom. Much of the recirculated fluid is laden with rock chips that have been removed from the hole bottom. Since there is less volume of cuttings to remove in medium and hard formations, the fluid circulation problem is not great. In soft formations with high rates of penetration, the cuttings removal problem is greatest.

Perhaps the most conventional approach is to employ three nozzles in the lower end of the drill bit between the three cutters directing three streams of high velocity fluid toward the bottom of the drilled hole. The fluid is then deflected upwardly through three spaces between the nozzle areas and the surrounding walls of the drilled hole to reach the annular space between the drill string and the drill hole. Because of the area occupied by the nozzle, the space between the nozzles and the wall of the drilled hole is somewhat restricted and the return flow tends to be equally split between the three return paths.

To enhance the horizontal or cross-flow of fluid in the bottom of the drilled hole, and thus improve the efficiency of the chip removal, some success has been had by plugging one of the three nozzles so as to cause additional cross flow from two of the nozzles towards the space adjacent the plugged nozzle.

In another prior art arrangement, two extended nozzle tubes have been used in conjunction with a third nozzle that diverts the fluid flow 180 degrees upward. The two extended nozzle tubes direct fluid flow to the hole bottom while the 180 degree curved nozzle extension directs fluid flow upwardly to increase the velocity of the fluid out of the bottom of the hole. However, the undesirable effects of this arrangement are that the 180 degree nozzle restricts the return fluid passageway and the continuous abrasive wear of the fluid through the 180 degree bend decreases nozzle durability.

Also, at least one-third of the hydraulic energy is not being expended at the hole bottom to dislodge and move rock chips with impact and lift forces. The area around the nozzles is not decreased to improve fluid passage.

In a co-pending patent application assigned to the same assignee as the present invention, one of the three nozzle passages is plugged and the nozzle cut away and replaced by a pick-up tube which extends from the lower end of the drilled hole to the space between the drill string and the surrounding walls of the drilled hole, with the purpose being to force fluid to travel horizontally along the bottom of the hole. While this arrangement shows some promise, one of its limiting characteristics is the rather small cross-section of such pick-up tube as a result of the limited space available in three-cutter drill bits.

Accordingly, a need still exists for improving the circulation of drilling fluid in three-cone drill bits.

SUMMARY OF THE INVENTION

In accordance with the present invention, a three cutter drill bit is formed with only two drilling fluid nozzles and the area normally occupied by the third nozzle forms a return flow passage on one side of the drill bit as large as space permits. If a conventional three-nozzle drill bit is being modified the third nozzle is eliminated and the area occupied by this nozzle is enlarged to allow for more fluid passage.

Flow restrictor means may be positioned adjacent the two nozzles extending outwardly to restrict flow in that area so that more of the fluid flow is directed through the single enlarged passage.

Conventional three-cutter drill bit bodies are either somewhat flat on their lower ends or more typically are curved or sloped upwardly forming a dome shaped space between the upper ends of the cutter support legs. With either approach, a space is created in the central portion of the drill bit below the lower end of the drill bit body and above the upper surfaces of the cone-shaped cutters.

It has been found that the effectiveness of chip removal by the drilling fluid is enhanced by positioning a flow diverter or deflector in this dome area having a lower surface which extends into the space between the upper surfaces of the cutters. Consequently, fluid striking the cutters in that area is diverted or directed to flow along the surface of the cutter while moving downwardly or upwardly, thus, enhancing the removal of cuttings and the cleaning between the cutter teeth. The flow diverter or deflector will also prevent a cuttings accumulation from building up in the dome area because of the recirculation of entrained fluid by the nozzles. This trapped fluid and cuttings must be recirculated to the hole bottom and out past the outboard side of the nozzles. The flow diverter or deflector will decrease the dome area and increase the flow velocity and prevent cuttings accumulation above the cutters. Such a flow diverter may be formed integral with the lower end of the drill bit body with sufficient clearance to permit the cutters to be mounted. Alternatively, an existing drill bit having the cutters already mounted may be provided with a diverter by cutting a hole in the central portion of the lower wall of this main drill bit body and inserting a cylindrical element having a lower cone-shaped portion that extends into the space between the cutters, with the diverter being welded in that position.

It has been found that a drill bit having the improvements outlined above provides significant improvement in the effectiveness of chip removal and hole penetration and is particularly useful in the softer rock formations. The use of extended nozzles is also advantageous in some situations when used with the dome diverter and the enlarged outlet passage.

BRIEF DESCRIPTION OF THE DRAWINGS

FIG. 1 is a perspective view of a drill bit showing a flow restrictor adjacent a drilling fluid outlet nozzle;

FIG. 2 is a perspective view of the drill bit of FIG. 1 rotated 120° to illustrate a nozzle cut-out area;

FIG. 3 is a top view of the drill bit of FIG. 1 illustrating the fluid flow across the hole being drilled;

BEST MODE FOR CARRYING OUT THE INVENTION

Figure 4:
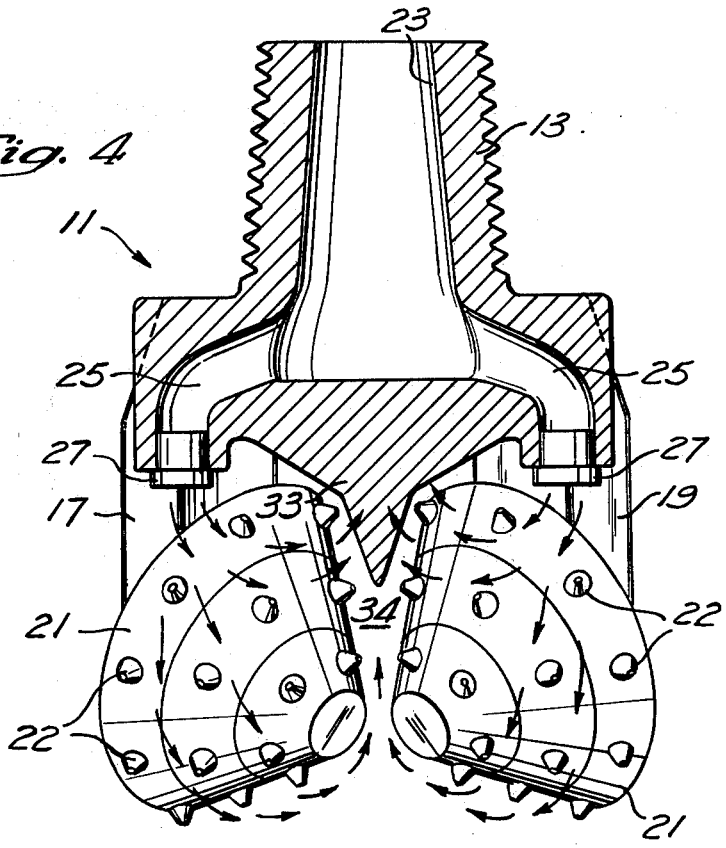
FIG. 4 is a cross-sectional view on line 4—4 of FIG. 3 showing the fluid flow out of the two outlet nozzles.

Referring initially to FIGS. 1 and 2, the rock bit of the present invention includes a main body 11 having an externally threaded, upper tubular portion 13 used for attaching the body to a conventional tubular drill string (not shown). The body 11 includes three downwardly extending circumferentially spaced legs 15, 17 and 19, formed integral with the body 11. Typically the drill bit body and legs are made in three sections which are then welded together to form a unitary structure.

On the lower end of each of the legs 15, 17 and 19 is mounted a cone-shaped cutter 21 having a plurality of teeth 22. The cutters are mounted in known fashion on roller shafts (not shown) extending inwardly from the legs so that the tips of the cones extend inwardly, generally towards the center of the drill bit body, although they do not meet at a common point, as is well-known in the art. The cutters are typically mounted on suitable bearings (not shown). As the drill bit body 11 is rotated by the drill string, the cutters will roll along the bottom of the hole being cut, while at the same time abrading the hole bottom due to the sliding and chipping action and due as a consequence of mounting the cones without a common central axis. The three cones are circumferentially spaced 120°, each substantially covering a 120° circular segment at the bit bottom, and each extending to grind the entire radius of a drill hole.

Referring to FIG. 4 as well as to FIGS. 1–3, it may be seen that the interior of the body is hollow forming a central cavity 23 and that passages 25 extend from the cavity 23 and open downwardly. Nozzles 27 are positioned in the lower ends of these passages so that drilling fluid pumped downwardly through the drill string passes through the cavity 23 to the passages 25 and downwardly through the nozzles 27 onto the cutters and the bottom of the drilled hole to carry away the drill cuttings. The passages 25 and the nozzles 27 are spaced from each other 120°, one of the nozzles being located between the legs 15 and 17 and the other being located between the legs 15 and 19.

On the third side of the drill bit body, between the legs 17 and 19, many of the prior art drill bits have a third nozzle and passage. In the present arrangement, however, no nozzle or passage connected to cavity 23 is provided and instead there is a cut-out area 29 which forms a return passage through which drilling fluid exiting from the nozzles can return upwardly from the bottom of the hole to the annular space above the drill bit between the drill string and the walls of the hole being drilled. The drill bit body may be initially formed with the cut-out area, or the nozzle positioned in that area in a conventional drill but may be cut away. As mentioned above, a third nozzle has, in the past, often been plugged for certain drilling situations. In the present arrangement, the entire area where the nozzle would be located has been removed, thus making an enlarged passageway to accommodate greater fluid flow in that area.

Adjacent each of the nozzles 27 there is positioned an outwardly extending flange or plate 31 which forms a fluid flow restrictor. As can be seen from FIGS. 1 and 3, the edge of the restrictor conforms to the exterior of the drill bit body and is welded to the body and the adjacent legs. The exterior of the restrictor 31 is curved like the exterior of the legs to conform to and be closely spaced from the surrounding walls of the drilled hole so that the restrictors limit or restrain upward flow of fluid in those areas.

Figure 5:
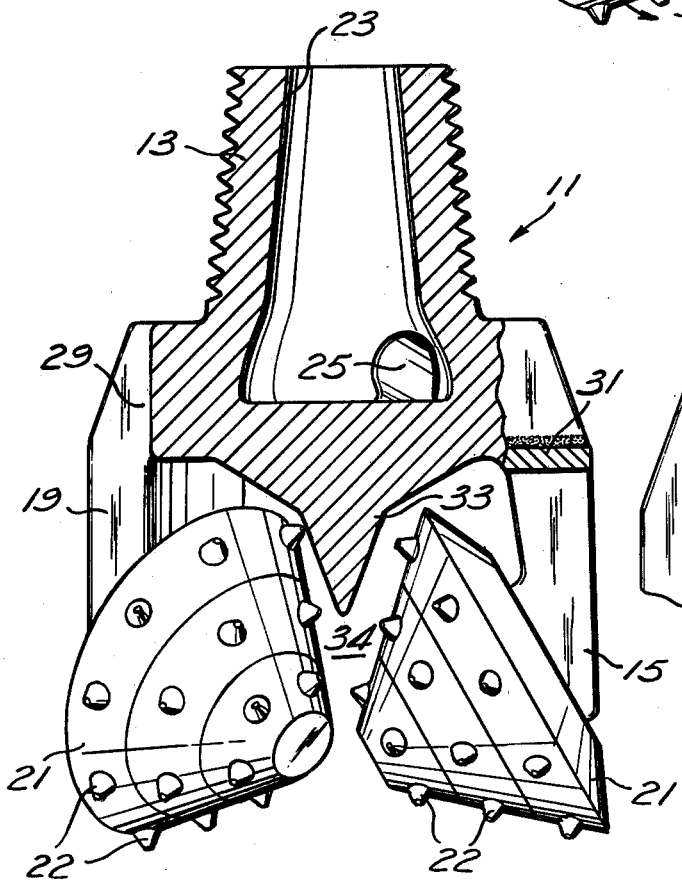
FIG. 5 is a cross-sectional view on line 5—5 of FIG. 3 showing the nozzle cut-out area and showing the flow restrictor.

Referring to FIGS. 4 and 5, the lower central portion of the drill body 11 extends downwardly forming a generally cone-shaped projection 33 which serves as a flow diverter for the drilling fluid. The diverter may also be thought of as a dome restrictor in that conventionally the body of a three cone cutter arches upwardly in that area forming a dome shaped space 34. Note that the tip of the cone extends downwardly into the central space or area formed by the cone-shaped cutters.

It is desirable that the flow diverter extends downwardly into the space between the cutters as far as possible, while still providing suitable clearance for the adjacent cutter teeth. However, if the diverter 33 is formed on the drill bit body 11 before the cutters are mounted, it is necessary to provide suitable clearance for the cutter mounting.

Figure 6:
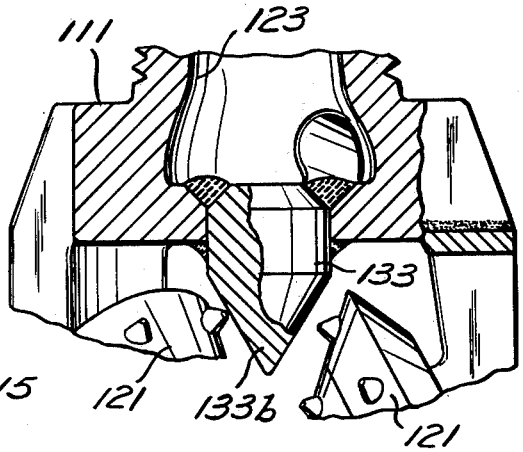
FIG. 6 is a cross-sectional view of a portion of a drill bit illustrating an alternate form of flow diverter in the center of the drill bit body.

FIG. 6 shows an alternate form of a dome shaped diverter. The drill bit body 111 shown in FIG. 6 is essentially identical to body 11 in the other figures except that the lower wall of surface of the body 111 is initially formed generally flat or arching upwardly, and a large hole is drilled through it opening into a cavity 123. A diverter 133 is positioned in the hole and welded to the drill body. As can be seen, the diverter has a cylindrical portion that fits within the hole in the bit body and it has a lower conical portion **133*b* which extends between the cone-shaped cutters 121**. This arrangement is advantageous from the standpoint that the diverter may be installed after the cutters have been mounted by inserting the diverter through the upper end of the drill bit body and welding the diverter in place. This also enables existing drill bits not having a diverter extending from the lower end of the drill bit body to be modified by drilling the hole through the upper end of the drill bit body and welding the diverter in place. A second advantage is that since the diverter is installed from above, it may be formed to conform more closely to the shape of the central space above and between the cutters, without concern for clearance space for mounting the cutters.

In operation of the drill bit shown in FIGS. 1–5 or in FIG. 6, high pressure drilling fluid is directed downwardly through the drill string into the cavity 23 where it is directed outwardly and downwardly through the nozzles 27 to form a pair of jets or streams of fluid directed onto the hole bottom and the cutter surfaces in the path of the jet. The purpose for the drilling fluid is of course to remove the earth and rock particles cut by the cutter teeth; and such removal operation should be done in the most efficient manner possible in that the removal of the cut material is a critical factor in determining the rate at which the hole is dug and the rate of wearing of the cutters and their bearings.

The drilling fluid passing through the nozzles will return upwardly above the drill bit into the annular space surrounding the drill string through the space between the drill bit and the drilled hole. The legs of the drill bit body are closely positioned adjacent to the walls of the hole being drilled. Hence, not much fluid can flow in that area. Conventionally, the return fluid flow for three cone cutters is in the space between the nozzle areas and the drilled hole. With three nozzles and three return paths the return flow is divided fairly uniformly. One short coming of this approach is that the drilling fluid striking the bottom of the drilled hole tends to be deflected directly upwardly to the space adjacent the nozzle through which the fluid was ejected. It is desirable that a greater cross-flow across the hole bottom and across the surfaces of the cutters be obtained to more efficiently remove the drill cuttings. With the arrangement illustrated, the area adjacent the nozzles 27 is closed by the flow restrictors 31. Consequently, the majority of the fluid is forced to flow upwardly through the enlarged passage 29 between the legs 17 and 19. This in turn forces the fluid striking the bottom of the hole to have a considerable cross-flow component across the bottom of the hole and across the surfaces of the cutter to improve the efficiency of the chip removal process. That is, since the fluid cannot simply bounce back upwardly around the nozzle from which it was ejected, it is forced to travel across the hole to the enlarged passage.

Further directing of fluid in the desired direction is obtained by the flow diverter 33 extending into the space between the cutters. Without the diverter there is a tendency for a significant portion of the fluid to strike cutter surfaces and be deflected directly towards an outlet passage thus performing a minimal amount of chip removal. However, with the diverter occupying such space, the fluid is forced to travel across the face of the cutters adjacent the cutter teeth to better clean cutter teeth and improve the efficiency of the removal process.

Thus, the combination of the dome flow diverter, the restrictors adjacent the two nozzles, the use of two jet nozzles rather than three and the use of the enlarged relief passage for the return flow on one side provides better bottom hole cross flow, better hole cleaning and better drilling penetration rates. Such features are useful in all sizes and types of drill bits whether air or liquid circulation for drill bits up to ten inches.

For larger size drill bits, it may be helpful to employ nozzle extension tubes (not shown) that would extend from the nozzles down to a point close to the bottom of the drilled hole. Such an arrangement will further enhance the cross-flow of drilling fluids adjacent the bottom of the drilled hole.

By increasing the total cross sectional area of the fluid flow path, there is of course a reduced pressure drop across such path. However, the percentage of pressure drop is greater than the percentage of area increase, assuming constant flow rate and orifice coefficient.

On the other hand, if the restrictors adjacent the nozzles are employed the overall cross-sectional area of the fluid flow path may be decreased even though an enlarged cut-out area is provided on the unrestricted side. This will result in increased velocity on that side with a relatively large exit flow path, which is advantageous for the removal of larger chip sizes and less regrind. The various features of the invention may be selected to best fit a particular drilling condition.

For example, in some softer formations where hole erosion around the drill bit body becomes a problem resulting in bore hole enlargement, a larger volume of cement is necessary to cement the casing that is installed after the hole is drilled. The enlargement of the bore hole adjacent to the bit reduces the effectiveness of the bit reamers and stabilizers causing the hole to be drilled in a crooked manner. It may be desirable to not utilize the flow restrictors adjacent the nozzles but to continue to use the other features, namely the dome restrictor, and the enlarged return flow passage. Increasing the cross-sectional area of the return passages in this manner will reduce the velocity from the bottom of the hole to the top of the bit thereby reduce formation erosion. However, hole cleaning is still improved because of the increased fluid flow rate, because of the improved cross-flow enhancement provided by the enlarged outlet and because of the dome restrictor diverting the fluid in the desired direction.

In raise bore pilot hole drill bits, it is desirable to use a drill string which is of larger diameter relative to the drill bit than is utilized in a normal drilling operation. The larger diameter drill string provides additional strength to accommodate the torque employed in connection with a raise bore operation. In such situations, a normal circulation flow rate of the drilling fluid can result in an excessive annular pressure loss due to the higher velocity caused by the smaller space through which the fluid can flow. This in turn can cause a back pressure on the hole bottom resulting in chip hold down and a decreased penetration rate. The use of some of the features of the present invention can alleviate and improve such situations. More specifically, use of the dome diverter without the annular restrictors adjacent the nozzle; and the use of the enlarged passage and the third nozzle area together with the use of two extended nozzle tubes will provide better bottom hole cleaning with a reduced flow rate.

Thus, in all the various situations described, it is desirable to utilize the dome diverter or restrictor and the two nozzle approach together with the enlarged return passage in the third nozzle area. In some situations it is desirable to use the extended nozzle tubes and in some situations it is desirable to have the annular restrictors adjacent the nozzles. Thus, the features of the present invention provide greater versatility for rock bit construction to improve performance of the drilling operation in a variety of specific drilling situations.

We claim:

1. A drilling bit comprising:

a main bit body having an upper end for attachment to a rotatable tubular drill string, said body including a cavity for receiving high pressure drilling fluid from said drill string;

a plurality of cone shaped cutters circumferentially spaced around the lower end of said body;

nozzle means mounted on said body between two of said cutters and connected to said cavity to receive high-pressure drilling fluid and form downward flowing jets of fluid;

a plurality of means for mounting said cutters extending downward from said body, two of said mounting means along with walls of a drilled hole defining an enlarged passage spaced from said nozzle means for permitting fluid flow entering said drilled hole through said nozzle means to flow upwardly through said passage to the annular space between said drill string and said drill hole; and flow diverter means depending from the central portion of the lower end of said body and into the central area between said cutters to divert fluid along the surface of said cutters.

2. The drilling bit of claim 1 wherein there are three of said cone-shaped cutters spaced around the lower end of said body thus creating three spaces between said cutters, said nozzle means include two nozzles, one in each of two of said spaces between said cutters, and said passage is located in the third space between said cutters.

3. The drilling bit of claim 2 including a tube connected to each of said nozzles and extending downwardly to near the level of the lowermost point of said cutters.

4. The bit of claim 3 including flow restrictor means for restricting fluid flow to the annular space around said drill string except through said passage.

5. The drilling bits of claims 1 or 2 wherein said diverter means occupies a substantial amount of the central area between said cutters while still providing suitable clearance for the adjacent cutter teeth.

6. The drilling bits of claim 5 wherein said diverter means is a cone-shaped projection whose tip extends downwardly into said central area.

7. The drilling bit of claims 1 or 2 including flow restrictor means adjacent said nozzle means to restrict flow of drilling fluid entering said drilled hole through said nozzle means upwardly adjacent said nozzle means to the annular space around said drill string.

8. The drilling bit of claim 7 wherein said restrictor means is welded to said main bit body adjacent said nozzle means and extends outwardly in close proximity to the surrounding walls of the drilled hole so that the drilling fluid is forced to flow through said passage to reach the annular space around the drill string.

9. A drilling bit comprising:

a main bit body having an upper end for attachment to a rotatable tubular drill string, said body including a cavity for receiving high pressure drilling fluid from said drill string;

a plurality of cone shaped cutters rotatably mounted on and circumferentially spaced around the lower end of said body;

nozzle means mounted on said body between two of said cutters and connected to said cavity to receive high-pressure drilling fluid and form downward flowing jets of fluid;

means defining an enlarged passage in the periphery of said body between two of said cutters and spaced from said nozzle means for permitting fluid flow entering a drilled hole through said nozzle means to flow upwardly through said passage to the annular space between said drill string and said drill hole; and flow diverter means depending from the central portion of the lower end of said body and into the central area between said cutters to divert fluid along the surface of said cutters, said diverter including a cylindrical portion which is welded in a circular hole in said main bit body, and said diverter including a cone-shaped portion on the lower end of said cylindrical portion, with the cone-shaped portion conforming to the central area between the cutters.

10. A drilling bit comprising:

a main bit body having an upper end for attachment to a rotatable tubular drill string, said body including a cavity for receiving high pressure drilling fluid from said drill string;

three cone shaped cutters rotatably mounted on and circumferentially spaced around the lower end of said body with the tips of the cutter cones extending generally inwardly toward each other;

nozzle means mounted on said body between two of said cutters and connected to said cavity to receive high-pressure drilling fluid and form downward flowing jets of fluid;

flow diverter means depending from the central portion of the lower end of said body shaped to fit into the central area between said cutters in close proximity to said cutters to divert fluid from said nozzles along the surface of said cutters.

* * * * *